US006485227B1

(12) United States Patent
Mathiowetz

(10) Patent No.: US 6,485,227 B1
(45) Date of Patent: Nov. 26, 2002

(54) CONCRETE BREAKING APPARATUS

(75) Inventor: Reinhold P. Mathiowetz, Marshall, MN (US)

(73) Assignee: R and G Construction Co., Marshall, MN (US)

( * ) Notice: Subject to any disclaimer, the term of this patent is extended or adjusted under 35 U.S.C. 154(b) by 0 days.

(21) Appl. No.: 09/412,667

(22) Filed: Oct. 5, 1999

(51) Int. Cl.[7] ..... E01C 23/08; E01C 19/26; E21C 25/00

(52) U.S. Cl. ..... 404/90; 404/94; 404/124; 404/128; 404/130; 299/39.4

(58) Field of Search ..... 404/83, 90, 94, 404/122, 124, 128, 30, 117; 299/39.4, 39.7, 39.9; 37/189, 386; 405/271

(56) References Cited

U.S. PATENT DOCUMENTS

| | | | | | |
|---|---|---|---|---|---|
| 2,909,106 | A | * | 10/1959 | Berrange | 404/124 |
| 3,662,658 | A | * | 5/1972 | Berrange | 404/124 |
| 3,950,110 | A | * | 4/1976 | Clifford | 404/124 |
| 3,966,346 | A | * | 6/1976 | Berrange | 404/124 |
| 4,074,942 | A | * | 2/1978 | Cochran | 404/121 |
| 4,090,570 | A | * | 5/1978 | Alexander | 172/116 |
| 4,147,448 | A | * | 4/1979 | Jeffery | 404/124 |
| 4,147,488 | A | | 4/1979 | Chiron | 425/174.8 |
| 4,334,799 | A | * | 6/1982 | Rautenbach | 404/124 |
| 4,422,795 | A | * | 12/1983 | Berrange | 404/124 |
| 4,634,311 | A | | 1/1987 | Jinnings et al. | 404/90 |
| 4,772,225 | A | | 9/1988 | Ulery | 439/620 |
| 4,919,566 | A | * | 4/1990 | Caron et al. | 404/121 |
| H946 | H | * | 8/1991 | Lonn | 404/121 |
| 5,217,321 | A | * | 6/1993 | Corcoran et al. | 404/121 |
| 5,439,273 | A | | 8/1995 | Price et al. | 299/37 |
| 5,462,387 | A | | 10/1995 | Roth | 404/90 |
| 5,562,365 | A | * | 10/1996 | Berrange | 405/271 |
| 5,967,242 | A | * | 10/1999 | Caron et al. | 172/817 |
| 6,004,076 | A | * | 12/1999 | Cook et al. | 405/271 |
| 6,065,904 | A | * | 5/2000 | Cook et al. | 405/303 |

* cited by examiner

*Primary Examiner*—Gary S. Hartmann
(74) *Attorney, Agent, or Firm*—Nawrocki, Rooney & Sivertson, P.A.

(57) ABSTRACT

A concrete breaking apparatus includes a wheeled support assembly having an open end to accommodate the variable positioning of an impact roller therebetween and a closed end opposite the open end. A frame having opposing longitudinal arms connected near one end so as to define open and closed end portions is pivotably supported by the wheeled support assembly on pivot arms which connect the frame to the wheeled support assembly. An impact roller is fixedly interposed for rotation between the opposing longitudinal arms of the frame near the open end portion thereof. The impact roller has opposing ends, an axis of rotation through the opposing ends, and a surface equipped with spaced apart primary and secondary impact members traversing the opposing ends of the roller. An energy transfer assembly joins the closed end portion of the frame to the wheeled support assembly so as to resiliently link the two structures and transfer energy to and from the impact roller during propulsion of the apparatus in a manner to thereby boost the breaking capabilities thereof and mitigate the transfer of shock and vibration to the wheeled support assembly.

13 Claims, 7 Drawing Sheets

CONCRETE BREAKING APPARATUS

TECHNICAL FIELD

The present invention relates to an apparatus for breaking concrete, and more particularly to a concrete breaking apparatus having an impact roller carried and configured to enhance the dynamic impact force delivered thereby so as to boost the concrete breaking capabilities thereof while mitigating shock and vibration concerns.

BACKGROUND OF INVENTION

Road construction projects, whether they be repair or reconstruction of streets or highways, typically require the removal of concrete road sections. Available processes for breaking up these concrete road sections are known to be time consuming and costly.

Common concrete breakers include pile driving machines which repeatedly drop or drive a variety of high density objects from an overhead mast, including but not limited to balls, drive shoes or "guillotines," which most often comprise a heavy weight having a sharpened lower end. With machines of this general style, several repeated blows to the concrete is customary to effectively and adequately split and break apart the concrete. Such apparatus and methods make for unacceptably slow going. Furthermore, the shock and vibration generated by the numerous impacting blows is transmitted throughout the entire machine thereby necessitating frequent maintenance checks, more often than not yielding worn, broken or otherwise failed parts or components which require replacement or repair. This further slows down work to the detriment of the project.

Concrete breakers which drag impact rollers, similar in design to conventional compaction roller assemblies, have made modest improvements over the "hammer" styles aforementioned, to the extent that set-up and break-down time has been eliminated. In short, the impact rollers are more user friendly, however, the issues of shock, vibration and component fatigue similarly plague the impact roller machines. Furthermore, it is common practice to make several passes over and through a work area with known impact rollers. Although the impact rollers are easier to "operate" and are capable of swifter coverage of a work area, they are not necessarily any more efficient at concrete breaking (i.e., the notion of improved or increased concrete breakage per impact) when compared to other methods or apparatus.

As such, it is most desirable to provide a concrete breaking apparatus capable of more quickly and efficiently breaking concrete when compared to those presently known. It is also desirable to provide a concrete breaking apparatus with enhanced concrete breaking capabilities. It is further desirable to provide a concrete breaking apparatus having enhanced concrete breaking capabilities that also reduces and greatly limits jerking and the transfer of shock and vibration. It is likewise advantageous to provide a concrete breaking apparatus capable of transferring energy to a rotating impact roller so as to accelerate the impact cutters of the roller toward the concrete surface.

SUMMARY OF THE INVENTION

The concrete breaking apparatus of the present invention includes a wheeled support assembly having an open end to accommodate the variable positioning of an impact roller therebetween and a closed end opposite the open end. A frame having opposing longitudinal arms connected near one end so as to define open and closed end portions is pivotably supported by the wheeled support assembly on pivot arms which connect the frame to the wheeled support assembly. An impact roller is fixedly interposed for rotation between the opposing longitudinal arms of the frame near the open end portion thereof. The impact roller has opposing ends, an axis of rotation through the opposing ends, and a surface equipped with spaced apart primary and secondary impact members traversing the opposing ends of the roller. An energy transfer assembly joins the closed end portion of the frame to the wheeled support assembly so as to resiliently link the two structures and transfer energy to and from the impact roller during propulsion of the apparatus in a manner to thereby boost the breaking capabilities thereof and mitigate the transfer of shock and vibration to the wheeled support assembly.

More specific features and advantages will become apparent with reference to the DETAILED DESCRIPTION OF THE INVENTION, appended claims, and the accompanying drawing figures.

DETAILED DESCRIPTION OF THE INVENTION

Figure 1:
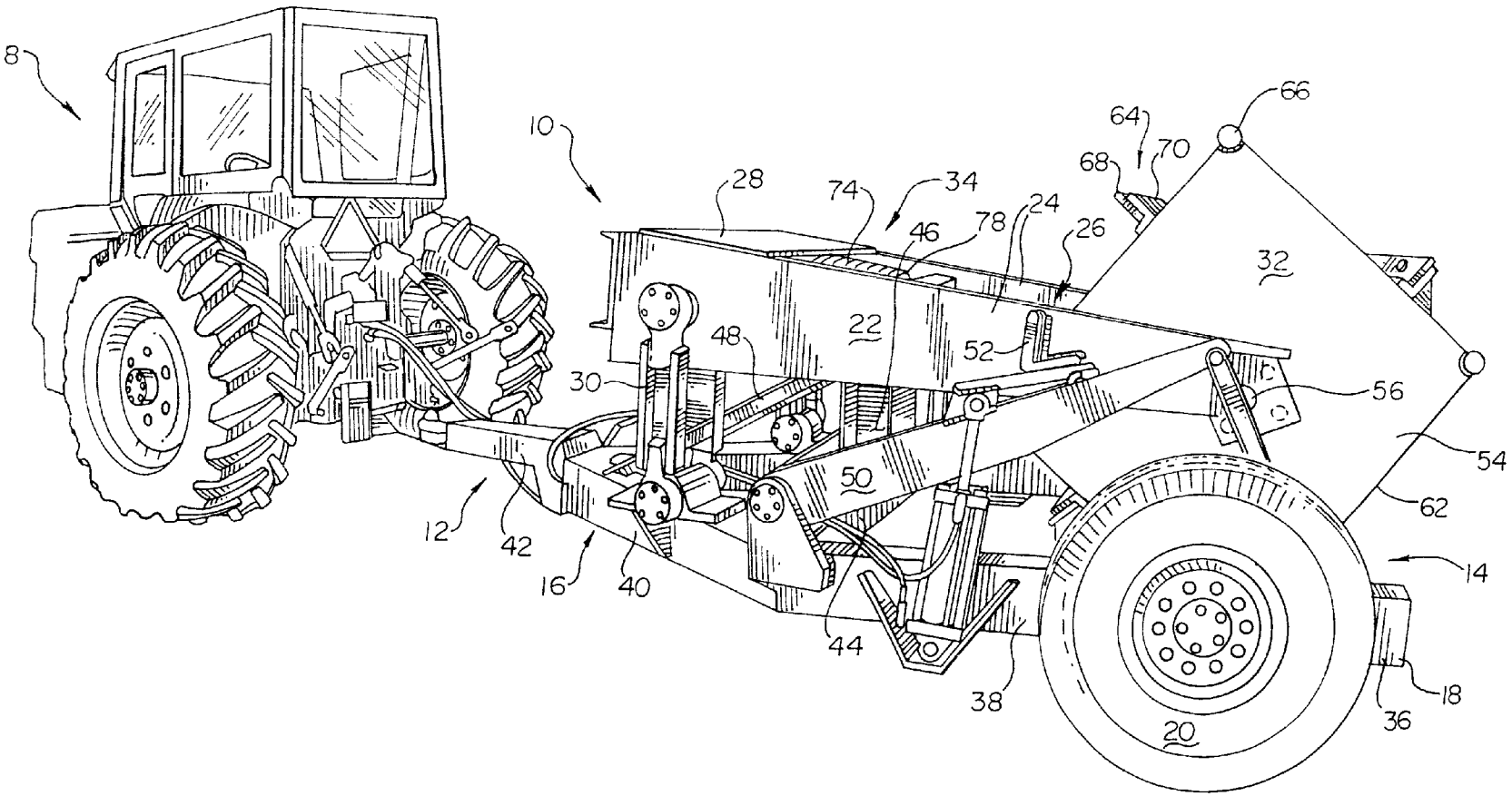
FIG. 1 is a partial perspective side view of the concrete breaking apparatus in tow behind a tractor and in a transport position (i.e., the impact roller in an elevated condition).

Referring to FIG. 1, there is shown an apparatus for breaking concrete, generally indicated at 10, being towed behind a tractor 8. Although highly desirable in a trailer or "tow behind" style, the concrete breaking apparatus of the subject invention is not so limited, as self-propelled embodiments are contemplated and equally embraced hereby.

Figure 2:
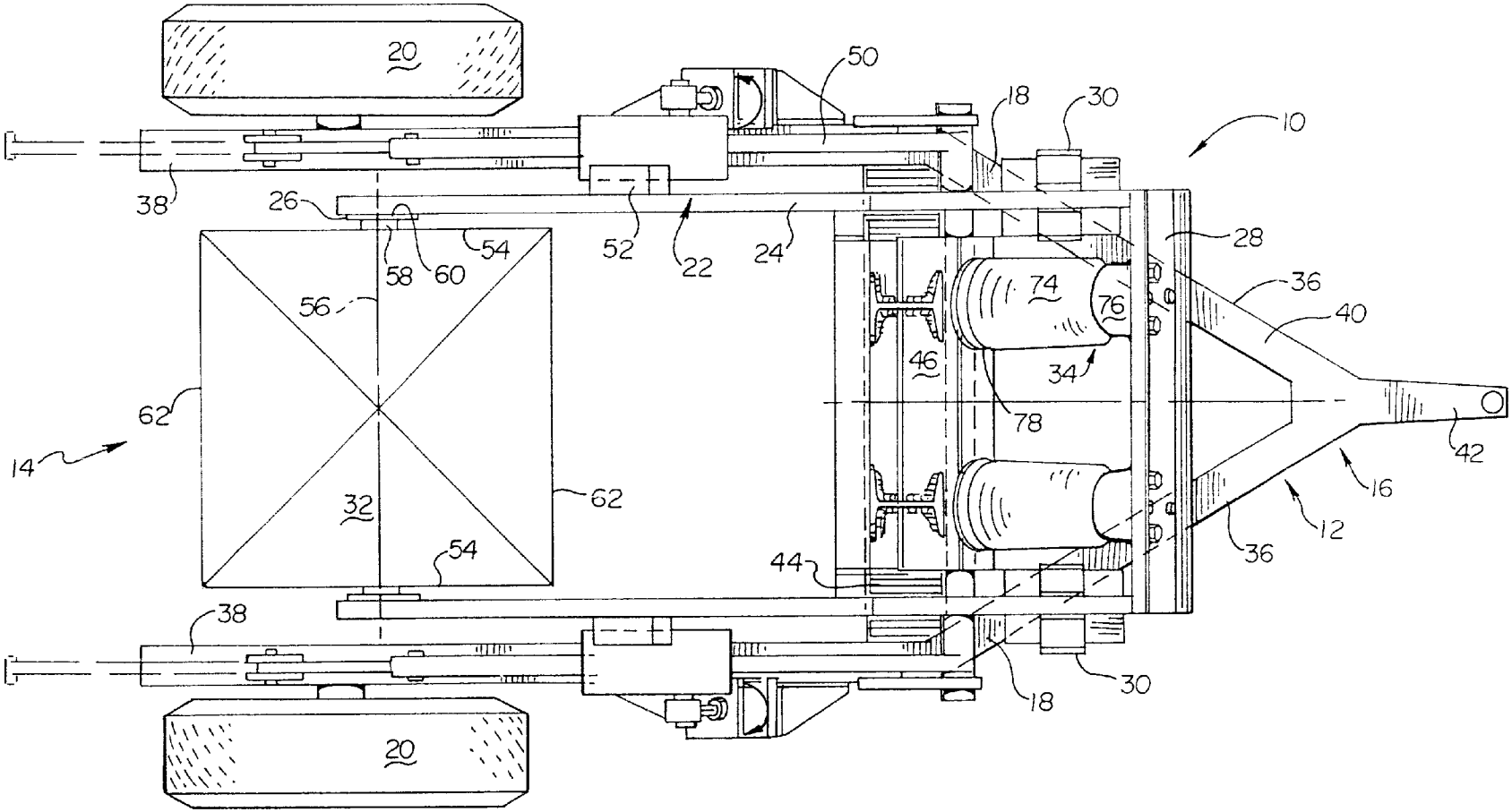
FIG. 2 is a schematic plan view of the concrete breaking apparatus, with particular emphasis on the frame and chassis.

Referring now to FIGS. 1 & 2, the concrete breaking apparatus 10 includes a wheeled support assembly or chassis 12 having open 14 and closed 16 ends, opposite sides 18 and wheels 20 positioned near the open end 14 of the assembly 12. An impact roller frame 22 having opposing longitudinal arms 24 connected near one end so as to define open 26 and closed 28 end portions is pivotably supported by the chassis 12 on pivot arms 30 which connect the frame 22 to the chassis 12 at the closed end portion 28 of the frame 22. An impact roller 32 is carried by the frame 22, specifically being fixedly interposed for rotation between the opposing arms 24, near the open end portion 26 thereof. An energy transfer assembly 34 connects the closed end portion 28 of the impact roller frame 22 to the chassis 12 to resiliently link the two structures in a way that permits energy and momentum transfer to and from the rotating impact roller 32 during propulsion of the concrete breaking apparatus 10. This greatly enhances concrete breaking operations by selectively imparting an enhanced dynamic impact force to the impact roller 32 to boost the breaking capability of the apparatus 10 and further permits attenuation (i.e., dampening) of any shock or vibration transmitted through the frame 22 from the roller impact.

The wheeled support assembly or chassis 12 is generally "wishbone" shaped, having opposing elongated arms 36. The arms 36 have linear 38 and angled 40 portions. The linear portions 38 of the opposing arms 36 are substantially parallel, with the angular portions 40 intersectingly terminating at a common stem 42 (i.e., hitch assembly) to form a closed end 42 for the chassis 12. The end of the chassis opposite the closed end 42 is open to thereby accommodate the variable positioning of the impact roller therebetween. Wheels 20 are independently mounted (i.e., no common axle) on the linear arm portions 38 of the chassis 12, near the open end 14 thereof, to thereby provide the desired clearance.

A chassis cross brace 44 connects the opposing chassis arms 36 near the interface of the linear 38 and angular 40 arm portions. A vertical chassis structure 46 extends upward from the chassis cross brace 44 and is in turn braced by opposing supports 48 which connect the vertical chassis structure 46 to the angular arm portions 40 of the chassis 12.

The impact roller frame 22 generally has a U-shaped configuration, with its opposing arms 24 being substantially parallel to the linear chassis arm portions 38. The frame 22 cooperates with the chassis 12 via several structures, namely the pivot arms 30 and the energy transfer assembly 34, and frame elevating assemblies 50 carried by the chassis 12. The frame elevating assemblies 50 hydraulically engage lifting members 52 included on the arms 24 of the frame 22, near the open end 26, so as to lift the impact roller 32, as when transporting the apparatus 10 to or from a work site.

The impact roller 32 is generally carried for rotation by the impact roller frame 22, specifically spanning the opposing arms 24 of the open end portion 26 of the frame 22. The impact roller 32 has opposing ends 54 and an axis of rotation 56 through the opposing ends 54. More particularly, trunnions 58 are positioned on the opposing ends 54 of the impact roller 32 so as to define the axis of rotation 56 for the impact roller 32. The trunnions 58 engage receivers 60 on the arms 24 of the impact roller frame 22 so as to be supported thereby. This support arrangement for the impact roller is preferred due to the heavy weight of the impact roller, however other support means know to those in the art are likewise suitable.

Figure 3:
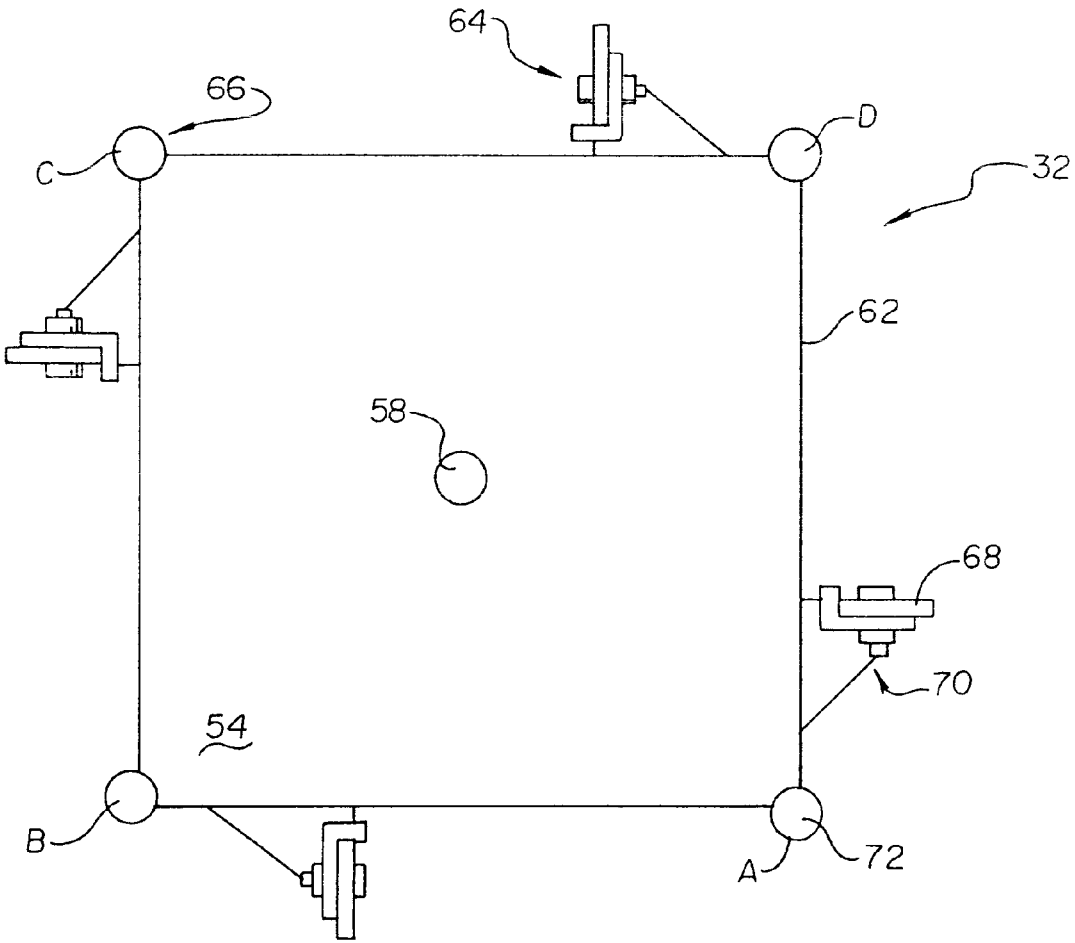
FIG. 3 is an elevational view of an end of the impact roller illustrating the various relationships between the components thereof.

Referring now to FIG. 3, the opposing ends 54 of the impact roller are generally angular and preferably square. Roller surfaces or faces 62 traverse the opposing ends 54 of the impact roller 32. Preferably the distance between the aligned corners of each of the opposing ends 54 equals the distance between adjacent corners of one of the opposing ends 54 (i.e., the impact roller 32 is cube like. in configuration), however other roller cross section geometries and length to width relationships are suitable and envisioned.

The roller surfaces 62 are equipped with spaced apart primary 64 and secondary 66 impact members which are positionally designated a–d in FIG. 3, beginning in the lower right corner of the roller and working clockwise. Generally speaking, the primary impact. members 64 are those which deliver a striking blow to break the concrete while the secondary contact members 66 establish a pivot point relative to the ground surface so as to permit a vaulting action for the impact roller 32 (i.e., elevation of the impact roller 32 relative to the wheeled support assembly 12).

The secondary members 66 are positioned at the junction of the roller faces 62 (i.e., the corners of the opposing ends 54), whereas the primary impact members 64 are positioned along each of the faces 62 of the roller 32. Like the secondary impact members 66, the primary impact members 64 are spaced 90 degrees from one another relative to the axis of rotation 56 of the roller 32. The distance between each of the primary impact members 64 relative to a "leading" secondary impact member (e.g., primary 64*b* to secondary 66*a*) is about two thirds the distance between adjacent secondary impact members (e.g., secondary 66*a* to secondary 66*b*). Using alternate terminology, it may be said that the primary impact members 64 lag or trail their leading secondary impact members by about 55–65 degrees relative to the axis of rotation 56 of the roller 32. These structural features and relationships greatly aid or facilitate the transfer of dynamic impact energy to the primary impact member during rotation of the impact roller.

The primary impact members 64 comprise cutting or impact blades 68 which are bolted, or otherwise replaceably attached, to blade holders 70 which are directly attached to the faces 62 of the roller 32 so as to extend from one opposing end 54 to the other opposing end 54 of the roller 32. The secondary impact members 66 comprise vault bars or rods 72 which likewise extend from one opposing end 54 of the roller 32 to the other and form rounded protruding edges between adjacent roller faces 62 (i.e., the vault bars 72 link adjacent faces 62 so as to form hemispherical corners for the opposing ends 54 of the impact roller 32).

The energy transfer assembly 34 comprises a resilient bladder 74, a bladder engaging element 76 which is attached to the resilient bladder 74 and a bladder anchor structure 78 opposite the engaging element 76. The bladder engaging element 76 connects one end of the bladder 74 to the impact roller frame 22 whereas the bladder anchor structure 78 joins the opposite end of the bladder 74 to the vertical chassis structure 46. As best seen in FIG. 2, the energy transfer assembly 34 is preferably equipped with a pair of resilient bladders 74. A single bladder, bag, membrane or other energy transfer device or linkage (e.g., spring etc.) is likewise embraced and contemplated.

The resilient bladders 74 are preferably a natural or synthetic rubber, or other elastomer exhibiting both durability (i.e., repeated compression and elongation) and elasticity (i.e., a substantially complete return after compression, elongation, expansion or other deformation). The resilient bladders are very "air bag" like in their quality, and to some extent in their function. Preferably, the bladders 74 are cylindrical, with their opposing ends indirectly joined to the impact roller frame 22 and the chassis 12 by the displacer 76 and the anchor 78 respectively.

Figure 4A:
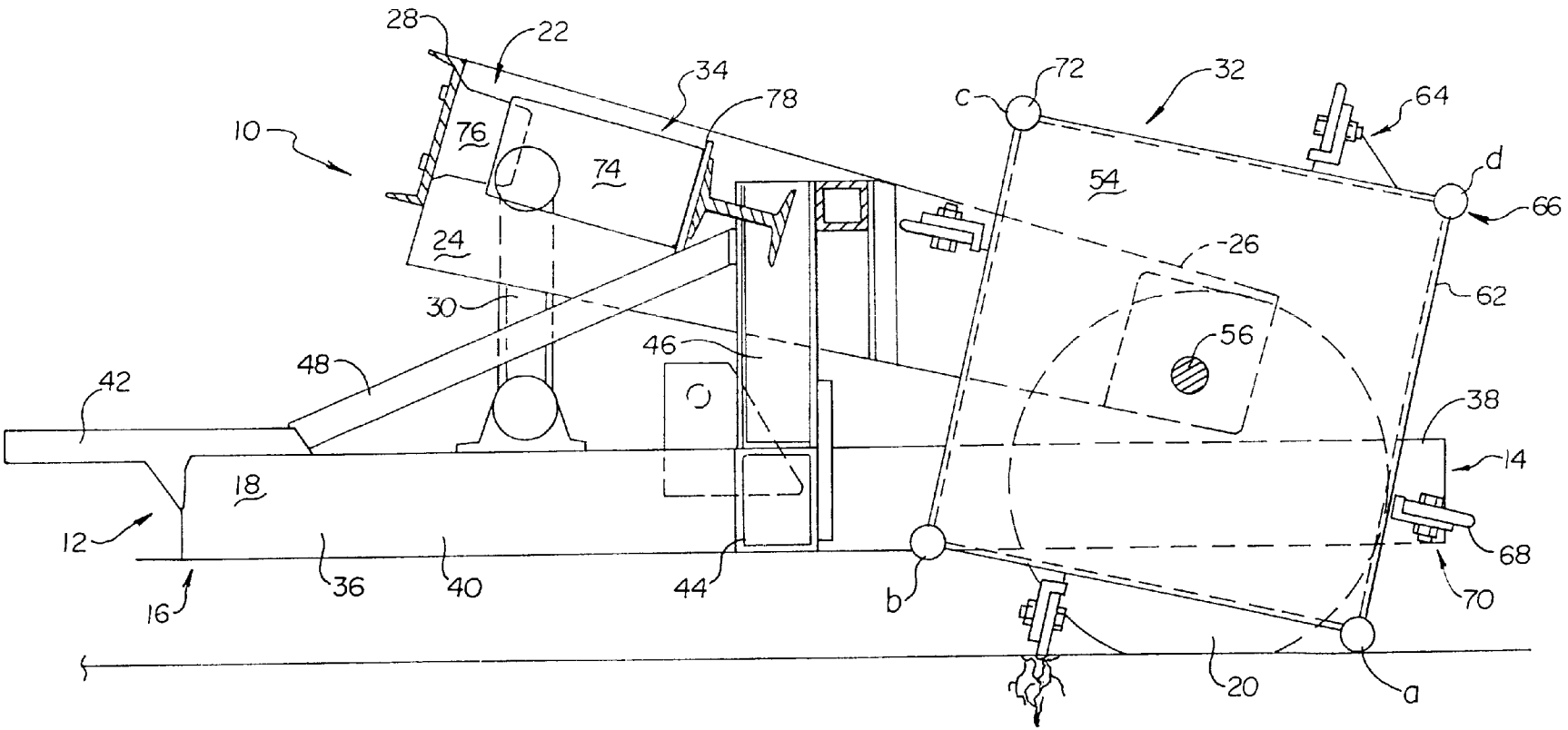
FIGS. 4A–4D illustrate the relative positions of the major assemblies of the concrete breaker as a function of impact roller rotation.
Figure 4B:
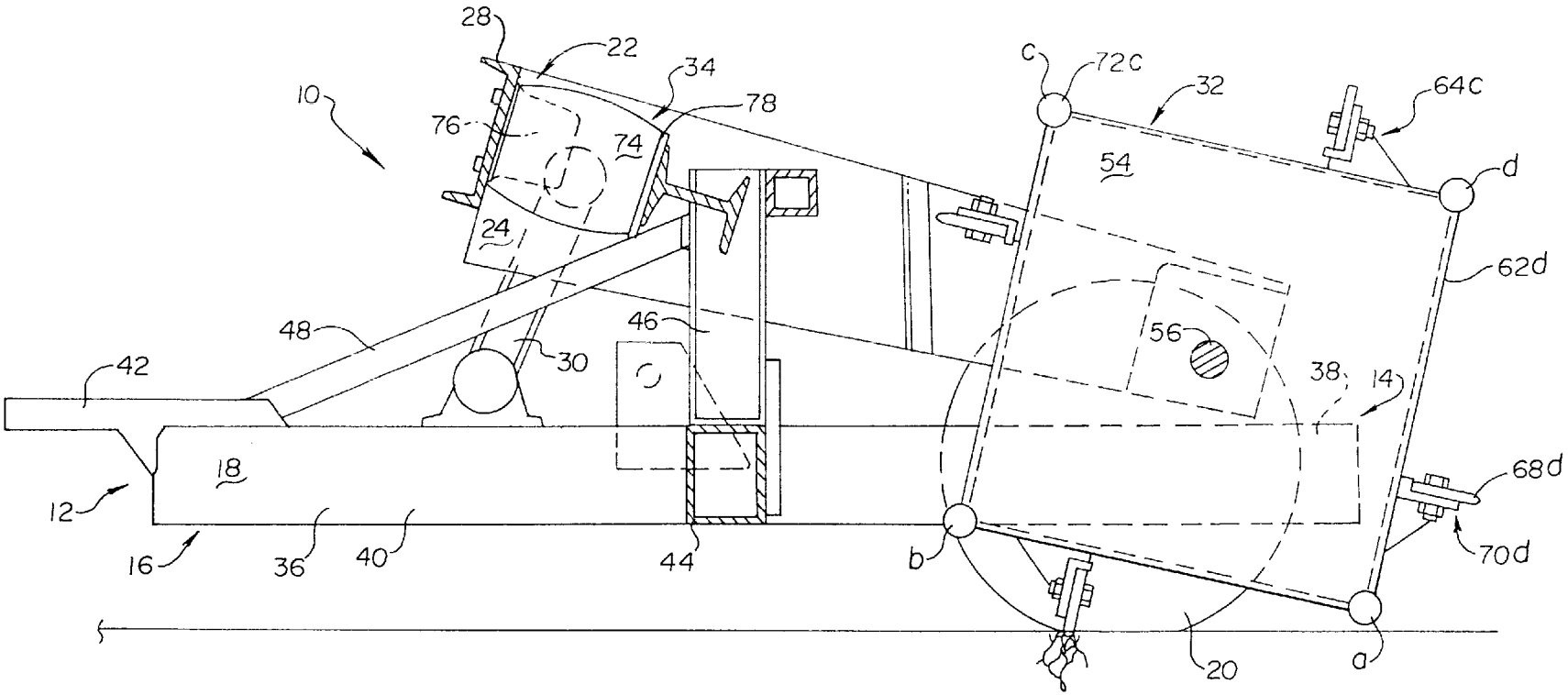
Figure 4C:
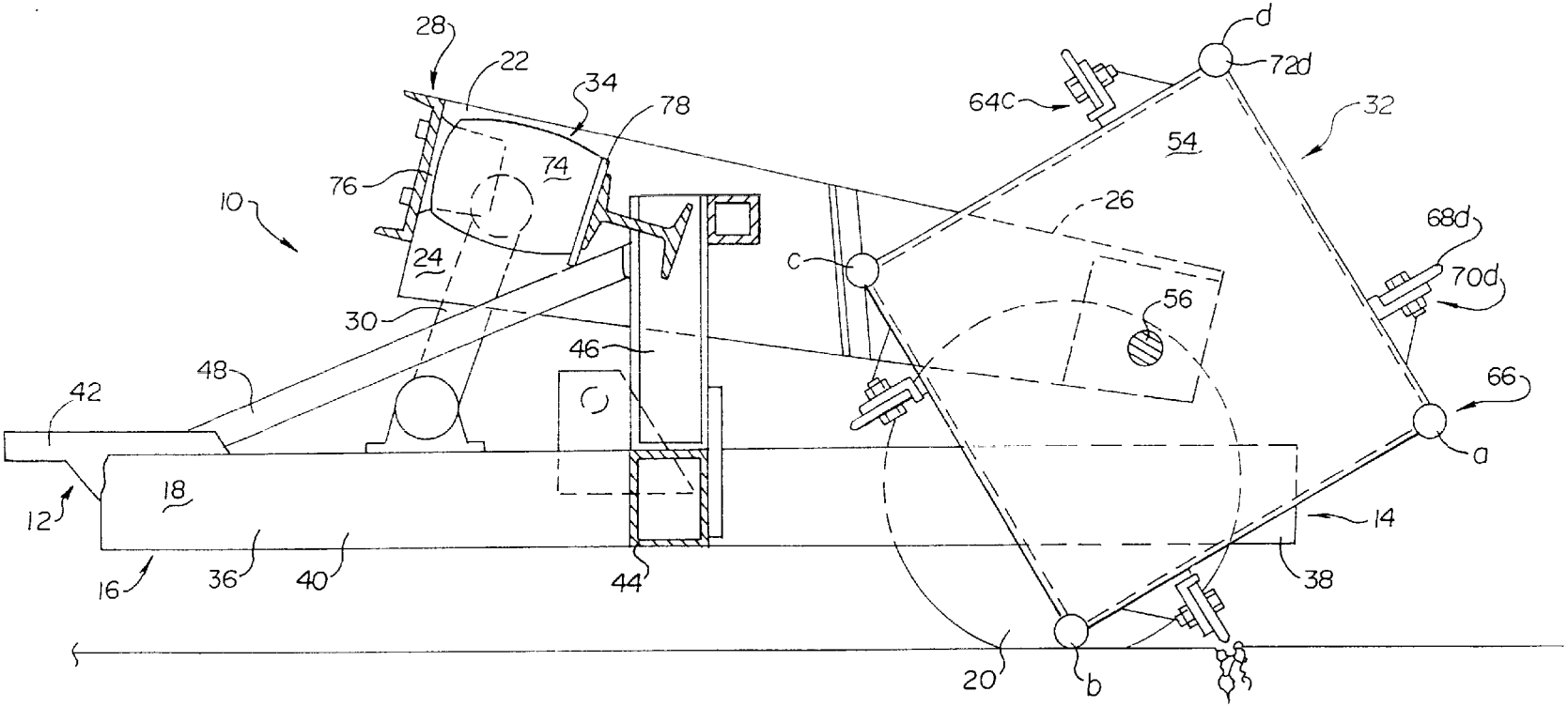
Figure 4D:
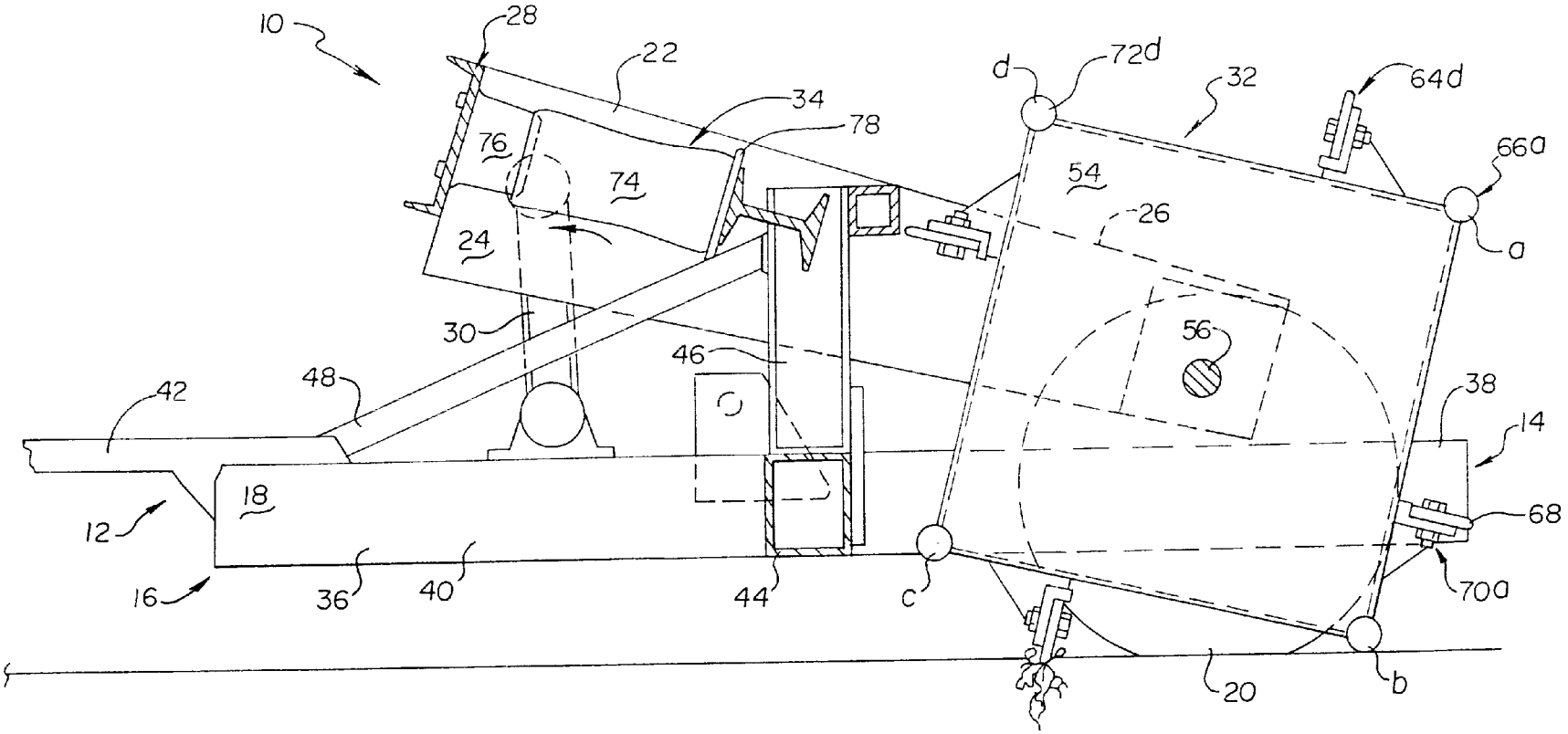

Referring now to FIGS. 4A–4D, the relative positions and relationships of the major assemblies of the concrete breaking apparatus 10 are shown as a function of impact roller rotation, namely from post impact of blade 64*a* in FIG. 4A to the impact of blade 64*b* in FIG. 4D. Generally, as the concrete breaker 10 is propelled forward (i.e., from right to left in FIGS. 4A–4D), the impact roller 32 rotates as indicated in a counter-clockwise rotation. As the vault bar 72*a* of FIG. 4A begins to lift off of the ground surface (FIG. 4B), the axis of rotation 56 will generally move rearward as the roller frame 22 moves rearward relative to the chassis 12 via pivoting on the pivot arms 30 which causes compression of the bladder 74 of the energy transfer assembly 34. At the moment a vault bar 72 lifts off the ground surface, the bladder 74 is generally at its maximum compression (i.e., the pivot arm 30 is at its smallest angle with respect to the chassis 12).

As the impact roller 32 of FIG. 4B rotates off of cutting blade 68*a* and onto pivot bar 72*b*, the impact roller 32 vis-a-vis the axis of rotation 56 begins to vault, moving generally upward and slightly forward with respect to the chassis 12 as shown in FIG. 4C. During this phase of the rotation, the angle between the pivot arm 30 and the chassis 12 begins to increase from the aforementioned minimum, as the bladder 72 begins to expand (i.e., decompress).

As the impact roller 32 of FIG. 4C continues its counterclockwise rotation, the stored energy and momentum of the bladder 72 is realized so as to pivotally accelerate the roller frame 22 forward as in FIG. 4D, thereby imparting (i.e, superimposing) an additional downward dynamic impact force component to the rotating impact roller 32, specifically the impact blade 68*b*. As the blade 68 strikes the ground surface, the bladder 74 is at its maximum elongation, while the angle between the pivot arm 30 and chassis 12 is at a maximum, exceeding about 90 degrees. As is readily appreciated, this process repeats through a single revolution of the impact roller 32. With the impacting roller 32 effectively capable of movement both rearward and upward via cooperation of the chassis 12, roller frame 22 and energy transfer assembly 34, greater concrete impact and thereby breaking efficiency is achieved.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. A concrete breaking apparatus comprising:

(a) a wheeled support assembly having an open end, a closed end opposite said open end, and opposite sides;

(b) a frame having opposing longitudinal arms connected near one end so as to define open and closed end portions for said frame, said frame being pivotably supported relative to said support assembly on pivot arms connecting said frame to said support assembly at said closed end portion of said frame, said pivot arms capable of forming variable angles relative to said open end of said frame to thereby variably position said frame above said support assembly;

(c) an impact roller fixedly interposed for rotation between said opposing longitudinal arms of said frame near said open end portion of said frame, said impact roller having opposite angular axial faces, an axis of rotation through said opposite axial faces, a multi-faceted roller surface, each facet thereof being spaced apart from said axis of rotation and supported by each of said opposite angular axial faces, each facet being flat and including a replaceable concrete chopping element substantially extending therefrom so as to exclusively engage a flat concrete ground surface; and (d) an energy accumulator interposed between said closed end portion of said frame and said wheeled support assembly so as to resiliently respond to changes in the position of said frame above said support assembly, said energy accumulator capable of compression when the pivot arm angle is at a minimum and capable of elongation when said pivot arm angle is at a maximum so to transfer energy to and from said impact roller during propulsion of said concrete breaking apparatus in a manner to boost the breaking capabilities thereof and mitigate the transfer of shock and vibration to said wheeled support assembly.

2. The apparatus of claim 1 wherein said energy accumulator comprises a resilient bladder and a bladder engaging element attached to said resilient bladder.

3. The apparatus of claim 2 wherein said energy transfer assembly further includes a bladder anchor structure positioned opposite said bladder engaging element, said bladder anchor structure being connected to said wheeled support assembly.

4. The apparatus of claim 2 wherein said resilient bladder is alternately compressed and elongated by said bladder engaging element as said frame pivots relative to said wheeled support assembly during the rotation of said impact roller.

5. The apparatus of claim 1 wherein said opposite angular axial faces of said impact roller have a square configuration.

6. The apparatus of claim 1 further comprising a plurality of vaulting members, each of said vaulting members positioned at a junction of adjoining facets of said multifaceted roller surface.

7. The apparatus of claim 6 wherein said replaceable concrete chopping elements lag said vaulting members by about 55 to 65 degrees relative to said axis of rotation.

8. The apparatus of claim 6 wherein the distance between any one of said replaceable concrete chopping elements relative to an immediately preceding vaulting member is about two thirds the distance between adjacent vaulting members.

9. A concrete breaking apparatus comprising:

(a) a wheeled support assembly having an open end, a closed end opposite said open end, and opposing sides;

(b) a frame having opposing longitudinal arms connected near one end so as to define open and closed end portions for said frame, said frame being pivotably supported relative to said support assembly on pivot arms connecting said frame to said support assembly at said closed end portion of said frame, said pivot arms capable of forming variable angles relative to said open end of said frame to thereby variably position said frame above said support assembly;

(c) a concrete breaker fixedly interposed for rotation between said opposing longitudinal arms of said frame near said open end portion of said frame, said concrete breaker having a multi-faceted roller surface supported by opposing axial faces, an axis of rotation passing through said opposing axial faces, each facet being flat and equipped with replaceable concrete chopping elements which substantially extend therefrom; and (d) an energy accumulator interposed between said closed end portion of said frame and said wheeled support assembly so as to resiliently respond to changes in the position of said frame above said support assembly, said energy accumulator capable of compression when the pivot arm angle is at a minimum and capable of elongation when said pivot arm angle is at a maximum so to transfer energy to and from said replaceable concrete chopping elements during propulsion of said concrete breaking apparatus in a manner to boost the breaking capabilities thereof and mitigate the transfer of shock and vibration to said wheeled support assembly.

10. The concrete breaking apparatus of claim 9 wherein said opposing axial faces have corners.

11. The concrete breaking apparatus of claim 10, wherein vaulting members are positioned at said corners so as to extend at least partially across said surface of said concrete breaker.

12. The concrete breaking apparatus of claim 11 wherein each of said replaceable chopping blades trail a leading vaulting member by about 55–65 degrees relative to said axis of rotation.

13. The concrete breaking apparatus of claim 11 wherein the distance between any one of said replaceable chopping blades relative to an immediately preceding vaulting member is about two thirds the distance between adjacent vaulting members.

* * * * *